United States Patent [19]

Kurita et al.

[11] 3,942,889

[45] Mar. 9, 1976

[54] RESIDUAL TONER REMOVING APPARATUS

[75] Inventors: Takaji Kurita, Kawachinagano; Takao Fujiwara, Sakai, both of Japan

[73] Assignee: Minolta Camera Kabushiki Kaisha, Osaka, Japan

[22] Filed: Feb. 25, 1974

[21] Appl. No.: 445,337

[30] Foreign Application Priority Data

Mar. 5, 1973 Japan ..... 48-25816
Mar. 19, 1973 Japan ..... 48-33560[U]

[52] U.S. Cl. ..... 355/15; 118/637; 15/1.5 R
[51] Int. Cl. ..... G03g 15/00
[58] Field of Search ..... 118/164, 637; 117/17.5; 355/15; 15/1.5

[56] References Cited

UNITED STATES PATENTS

| | | | |
|---|---|---|---|
| 2,751,616 | 6/1956 | Turner, Jr. et al. | 118/637 X |
| 3,132,037 | 5/1964 | Hunter | 118/637 X |
| 3,483,679 | 12/1969 | Balbierer | 118/637 X |
| 3,534,427 | 10/1970 | Severynse | 355/15 |
| 3,590,412 | 7/1971 | Gerbasi | 15/1.5 |
| 3,655,373 | 4/1972 | Fisher et al. | 96/1.4 |
| 3,685,485 | 8/1972 | Kutsuwada et al. | 355/15 |
| 3,780,391 | 12/1973 | Leenhouts | 355/15 |
| 3,795,025 | 3/1974 | Sadamitsu | 355/15 |

OTHER PUBLICATIONS

IBM Technical Disclosure Bulletin; Brush Cleaning Method; Krause, K.A.; Vol. 12 No. 11 Apr. 70 p. 1822.

IBM Technical Disclosure Bulletin; Brush Cleaner with Electrostatic Precipitator; Roller et al.; Vol. 15, No. 12, May 73, p. 3643.

*Primary Examiner*—Mervin Stein
*Assistant Examiner*—Douglas Salser
*Attorney, Agent, or Firm*—Wenderoth, Lind & Ponack

[57] ABSTRACT

A residual toner removing apparatus which comprises a rotatable cleaning brush enclosed, except for two gaps, by a casing plate and a restriction board housed in a housing with an opening adjacent to a known photoreceptor surface. During rotation, brush hairs contact the casing plate to charge it with opposite polarity to toner particles, while the bursh hairs are compressed by the restriction board, thus the cleaning brush acting like a fan for circulation of air and entrained toner particles, which toner particles are mostly attracted by the casing plate and the housing wall forming an air flow chamber. A scraper actuated manually or motor-driven automatically at arbitrary times is advantageously provided in the air flow chamber for scraping off the adhering toner particles.

14 Claims, 8 Drawing Figures

RESIDUAL TONER REMOVING APPARATUS

The present invention relates to dry-copy, transfer process photo-copying apparatus, and more particularly to a unitary residual toner removing apparatus for use therein.

A conventional means for removal of residual toner comprises a rotatable brush, which in a copying apparatus, is located adjacent to a photoreceptor surface or to the path along which photoreceptor surface is fed, may contact the photoreceptor surface and is associated with a vacuum-producing means and a filter bag or similar means for reception of removed toner particles. The brush is rotated at high speed, thereby removing toner particles from the surface of the photosensitive photoreceptor, and these loosened particles are withdrawn by the vacuum means into the reception bag. Such conventional means are efficient in the removal of toner particles, but have the disadvantage of bulkiness, because of the necessity for the provision of ducts, separate vacuum-producing means, and bag, which makes it difficult to provide a compact copying apparatus. Other disadvantages associated with conventional toner removal means are that provision of a vacuum-producing means raises initial expense of a copying apparatus, and makes the maintenance thereof more difficult, and that production of a vacuum raises power requirements, and hence the price per copy obtained.

It is accordingly an object of the present invention to provide an improved residual toner removing apparatus.

It is another object of the present invention to provide a residual toner removing apparatus which is compact and operates efficiently without complex associated equipment.

It is a further object of the present invention to provide a toner removing apparatus having low power requirements.

It is a still further object of the invention to provide a residual toner removing apparatus that is simple in construction and easy of maintenance.

In accomplishing these and other objects there is provided according to the present invention, a residual toner removing apparatus contained in a single housing, wherein there is provided a rotatable brush which may contact a photosensitive photoreceptor surface through an open portion of the housing wall, a certain portion of the periphery of which is enclosed by a casing which contacts but does not compress the hairs of the brush, and another, smaller, portion of the periphery of which is compressed by a restriction board. The portions of the brush not covered by the casing or restriction board constitute gaps which communicate with the interior of the housing. During rotation of the brush, frictional contact of the brush hairs with the casing establishes an electrical charge with opposite polarity to toner particles on the casing, air and toner particles removed from the photoreceptor surface are carried by the brush and expelled through one of the abovementioned gaps, and air circulates through the interior of the housing and is drawn through the other gap, into contact with the brush. Heavier expelled toner particles fall directly into a receptacle provided at a lower portion of the housing. Lighter expelled toner particles are carried a certain distance by the circulating air, and are then attracted and adhere to the outer side of the charged casing, or depending on polarity are attracted and adhere to the inner side of the housing. At suitable intervals, adhering toner particles are removed from the casing and housing and directed into the abovementioned receptacle by a scraper which is provided between the housing and the casing, and which may be actuated manually, driven by a motor, or actuated automatically at required times by a motor and associated electronic means.

According to a 1st embodiment of the present invention, the scraper is moved merely manually, while in a 2nd embodiment, the manual operation of the scraper is associated with upwards or downwards movement of a press roll for the supply of copy paper for easy replenishment of copy paper sheets and efficient cleaning of adhering toner particles. In a third embodiment, the scraper is motor-driven and adapted to automatically function when the photoreceptor drum completes preset revolutions or when the supply of copy paper in a paper feeding device falls below a preset level.

A better understanding of the present invention may be had from the following full description of several embodements thereof, when read with reference to the attached drawings. In the drawings, in which like numbers refer to like parts, FIG. 1 is a schematic cross-sectional view of a residual toner removing apparatus according to a 1st embodiment of the invention;

Figure 1:
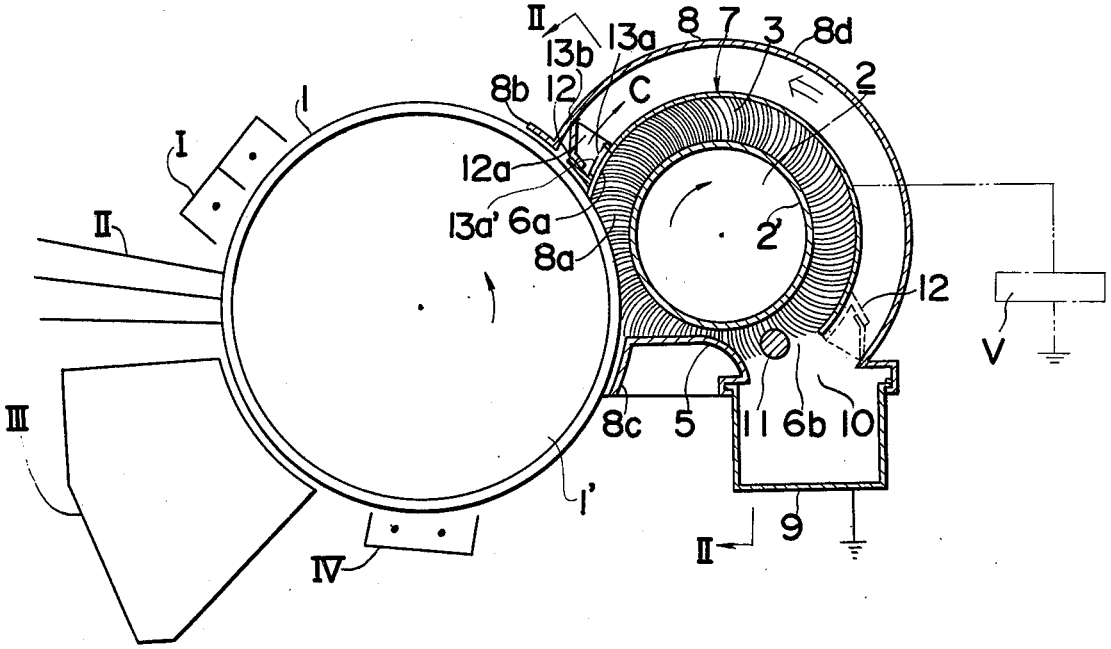

Referring initially to FIG. 1, there is shown a brush 2 partially enclosed by a casing plate 7 within a housing 8, and contacting the surface 1 of a photoreceptor provided around the outer periphery of a rotatory drum 1'. The brush 2 is constituted by a rotatory drum 2' around the entire outer periphery of which there are attached brush hairs 3, which may be rabbit or other animal fur, or synthetic fiber products such as acrylnitrile. The casing plate 7 is made of an electrically conductive material and encloses the top and rear portions (top and right portions in the drawing) of the brush 2, and is disposed on a curve generally parallel to the outer periphery of the brush drum 2'. The distance of the casing plate 7 from the brush 2 is slightly less than the length of the brush hairs 3, whereby, when the brush 2 is rotated, the brush hairs 3, which extend outwards due to centrifugal force, come into frictional contact with the casing plate 7 and produce an electrical charge thereon with opposite polarity to toner particles.

The housing 8 comprises a barrel-like main portion **8*d*, which encloses the area around the top and rear portions of the casing plate 7 and is generally parallel thereto, whereby, between the housing main portion 8***d* and the casing plate 7, there is formed a chamber C through which air and toner particles may pass, as described below. The top, front end of the housing main portion 8*d* extends forwards further than the top, front portion of the casing plate 7, whereby there is formed a gap 6*a* over which the brush 2 is not covered by the casing plate 7, and which communicates with the chamber C. The front side of the housing 8 forms upper and lower front wall portions 8*b* and 8*c*, which are curved to lie on the arc of an imaginary circle concentric with the photoreceptor drum 1', and between which there is a gap 8*a*. The housing front wall portions 8*b* and 8*c* are in close proximity to the outer periphery of the photoreceptor drum 1', which extends into the gap 8*a* and is contacted by the hairs 3 of the brush 2. When the photoreceptor drum 1' is rotated, successive portions of the photoreceptor surface 1 thereof come into contact with the brush 2 after passing various stages as employed in a conventional photocopying apparatus, such stages comprising, for example, a corona charging unit I, for sensitization of the photosensitive surface 1 of the drum 1', an exposure section II where an electrostatic latent image is produced on the sensitized photoreceptor surface 1 by exposure thereof, a development section III, where the exposed surface is dusted with a toner powder carrying a charge opposite to that of the electrostatic image, and a transfer section IV, where the photoreceptor surface 1 comes into contact with copy paper to transfer the image to the paper, the paper being supplied to contact the photoreceptor surface 1 and subsequently transferred to the next stage, for example, a heater stage, by suitable means not shown. Each portion of the photoreceptor surface 1 of the drum 1' is cleaned by the brush 2, in readiness for sensitization at the charging unit I and production of another copy.

The lower front wall portion 8*c* is in integral connection with a restriction board 5, which extends rearwardly therefrom. The greater portion of the restriction board 5 is removed from the outer periphery of the brush drum 2' by a distance that is considerably less than the extended length of the brush hairs 3, whereby, upon rotation of the brush 2, brush hairs 3 passing the location of the restriction board 5 are compressed somewhat and air is expelled from therebetween. The rear end of the restriction board 5 does not extend as far as the lower rear end of the housing main portion 8*d*, whereby the lower rear portion of the housing 8 forms a fairly broad open portion 10. Below this opening 10 there is mounted a removable reception bin 9, which is for the reception of toner particles, as described in further detail below, and is mounted on suitable attachment portions formed at the rear end of the restriction board 5 and the lower rear end of the main housing portion 8*d*. Attachment of the bin 9 to the restriction board 5 and housing 8 is made hermetic. The bin 9 (and hence housing 8) is grounded electrically. Between the rear end of the restriction board 5 and the lower rear end of the casing plate 7 there is formed a gap 6*b* over which the brush 2 is not contacted by the restriction board 5 or casing plate 7 and which is above the opening 10 leading to the bin 9. A bar 11, which extends transversely in the housing 8 and opposite ends of which are fixedly mounted in the housing end walls (not shown), lies in a generally central position of the gap 6*b* at a distance less than the length of the brush hairs 3 from the outer periphery of the brush drum 2'. Upon rotation of the brush 2, the brush hairs 3 coming to the gap 6*b* strike against the bar 11.

A slidable scraper 12 is provided in the chamber C between the casing plate 7 and housing 8. The scraper 12 is made of stiff, non-conductive material, and comprises side walls 12*a*, and top and bottom scraper boards 13*a* and 13*b*, which respectively contact the inner side of the housing main portion 8*d* and the outer side of the casing plate 7. The scraper 12 is normally positioned at the front end of the chamber C, in the vicinity of the gap 6*a*, but may be moved along to the rear end of the chamber C, that is, to above the opening 10, as indicated by the dotted line portion of FIG. 1. During this motion, the scraper boards 13*a* and 13*b* clean toner particles from the inner side of the housing main portion 8*d* and the outer side of the casing 7 and direct the particles to the opening 10 and into the reception bin 9. A hole 13*a'* is provided in the bottom scraper board 13*b* of the scraper 12 at a position corresponding to the inlet gap 6*a*, so that the scraper 12 may not hinder the passage of air throuth the chamber C. The scraper 12 is moved upon manual rotation of a knob 15, which is provided externally to the housing 8, and is connected to the scraper 12 through an arm portion 16 and a connector 17 described below.

Figure 2:
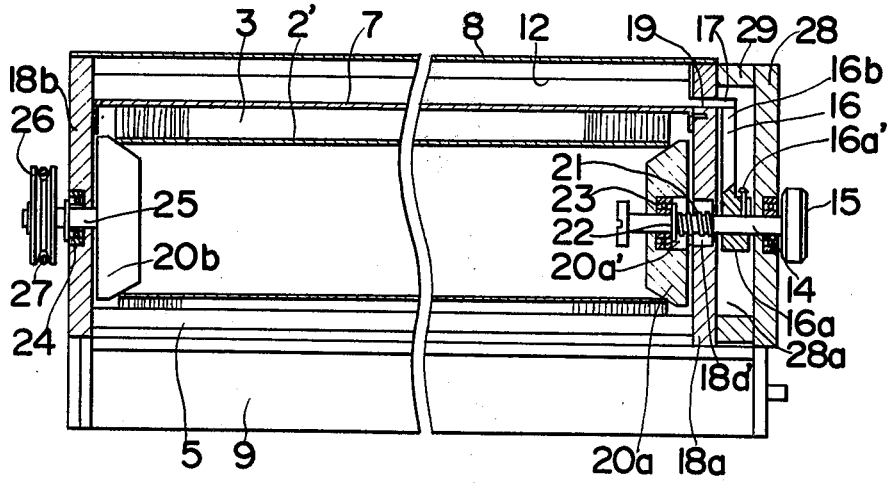
FIG. 2 is a cross-sectional view taken along the line II—II of FIG. 1.

Referring now to FIG. 2, the brush drum 2' is supported and driven by two support elements 20*a* and 20*b*. The support elements 20*a* and 20*b* are each in the form of a truncated cone, and are mounted with the bases thereof generally parallel to the inner sides of the housing side walls 18*a* and 18*b*, respectively, and with the tapering portions thereof extending into the interior of the brush drum 2', whereby the drum 2' is supported on the taper portions of the support elements 20*a* and 20*b*. The support element 20*b* is fixedly mounted on one end of a drive shaft 25, which passes through the housing side wall 18*b*, wherein it is rotatably mounted in a bearing 24, and on whose other end there is fixedly mounted a drive pulley 26. A drive belt 27 passed arund the pulley 26 is connected to a suitable drive means (not shown) upon actuation of which the pulley 26 and support element 20*b* may be rotated at high speed.

The other support element 20*a* comprises a cut-out portion 20*a'*, which is formed in the central portion of the base side of the support element 20*a*, that is, the side thereof nearer to the housing side wall 18*a*. In the inner side of the housing side wall 18*a*, there is formed a cut-out portion 18*a'*, which is formed in line with the cut-out portion 20*a'* of the support element 20*a*. Over the outer side of the housing side wall 18*a* there is provided a cover 28, which is connected to the side wall 18*a* through a spacer 29, there thus being formed an enclosed space 28*a* between the cover 28 and the housing side wall 18*a*. A shaft 14 extends completely through and may rotate freely in the support element 20*a*, side wall 18*a*, enclosure 28*a*, and cover 28, one end of the shaft 14 being in the interior of the brush drum 2' and having mounted thereon a screw or other suitable retention means, and the other end of the shaft 14 lying on the outer side of the cover 28, and having fixedly mounted thereon the abovementioned knob 15. The shaft 14 is supported in a bearing provided in the cover 28, and in a bearing 23 provided in the support element cut-out portion 20*a'*. The support element 20*a* may rotate freely about the shaft 14. Around that portion of the shaft 14 lying in the cut-out portions 18*a'* and 20*a*′, of the side wall 18*a* and support element 20*a*, there is mounted an expansion spring 21, at opposite ends of which there are provided stop rings 22 around the shaft 14. The housing side wall 18*a* being fixed, the spring 21 urges the support element 20*a* into firm contact with the brush drum 2′, whereby the drum 2′ is moved into firm contact with support element 20*b*. Thus, drum 2′ is held firmly between the taper portions of the support elements 20*a* and 20*b*, and may be rotated upon rotation of the support element 20*b* by the pulley 26 and belt 27.

One end 16*a* of the abovementioned arm portion 16 is fixedly attached by means of a pin 16*a*′ to that portion of the shaft 14 lying in the enclosure 28*a*. The arm portion 16 is adjacent and generally parallel to the side wall 18*a*, and the other end 16*b* thereof is near the outer edge of the side wall 18*a* and is in fixed or integral attachment with one end of the abovementioned connector 17, which extends at approximately right-angles from the arm portion 16, and passes through a slit 19 formed near the outer edge of the housing wall 18*a*, and whose other end is in fixed attachment to the scraper 12 (FIG. 1). The slit 19 extends in a curve from the front end to the rear end of the chamber C formed between the casing 7 and housing 8, whereby upon rotation of the knob 15 the scraper 12 may be moved along the entire length of the chamber C.

Referring mainly to FIG. 1, the operation of the abovedescribed residual toner removing apparatus is as follows. The photoreceptor drum 1′ is rotated at a moderate speed and the brush 2 is rotated at a high speed, the drum 1′ and the brush 2 being rotated in opposite directions. After passing the transfer stage IV and transferring an image to copy paper, a particular portion of the photoreceptor surface 1 of the drum 1′ to which excess toner particles still remain attached, is brought to the gap 8*a* in the front of the housing 8 and into contact with the brush 2, which removes the remnant toner particles from the photoreceptor surface 1. This portion of the photoreceptor surface 1 is then carried to the charging unit I, and other stages to repeat the copying process in a conventional manner, as described earlier. As the brush 2 rotates, the brush hairs 3 carry toner particles removed from the surface of the photoreceptor surface 1 upwards into that portion of the brush 2 periphery enclosed by the casing 7, at the same time drawing in air through the hole 13*a*′ of the scraper 12 and through the gap 6*a* constituted between the forward edge of the casing 7 and the photoreceptor surface 1 in the gap 8*a* of the housing 8. While moving within the area enclosed by the casing 7, the brush hairs 3 tend to straighten out, due to the centrifugal force produced by the high speed rotation of the brush 2, and the brush hairs 3 contact the inner side of the casing 7. This frictional contact of the brush 3 with the casing 7 results in the imposition of an electrical charge with polarity opposite to toner particles on the casing 7, which, as noted earlier is made of electrically conductive material. Also, since the distance of the casing 7 from the outer periphery of the brush drum 2′ permits extension of the brush hairs 3, over this portion of the brush 2 periphery, the brush 2 effects a function similar to that of a fan, the brush hairs 3 being extended like the vanes of a fan, whereby air and toner particles are drawn in the direction of rotation of the brush 2. In order words, air is drawn in through the gap 6*a*, and air and entrained toner particles are carried towards the gap 6*b* formed at the lower rear end of the brush 2, and communicating with the open portion 10 above the reception bin 9. Upon being brought to the gap 6*b*, both the air and entrained toner particles tend to move outwards with respect to the brush 2, and into the open portion 10, due to centrifugal force. When the brush hairs reach the central portion of the gap 6*b*, the brush hairs 3 strike against the transverse bar 11 which dislodges any remaining toner particles, both directly and by creating a turbulent air flow, whereby these remaining toner particles also move, due to centrifugal force, into the open portion 10. After passing the gap 6*b*, the brush hairs 3 come into contact with the restriction board 5, which compresses the brush hairs 3, whereby air is driven rearwards from therebetween, into the gap 6*b* and open portion 10. Thus, during rotation of the brush 2, there are constant forces urging air and toner particles away from the brush 2 through the gap 6*b*. After passing the location of the restriction board 5, the brush hairs 3 again come into contact with the photoreceptor surface 1, remove toner particles therefrom and repeat the abovedescribed circuit.

Since the bin 9 and rear portion of the housing 8 are enclosed areas, air expelled through the gap 6*b* travels through the chamber C to the gap 6*a*, through which it is drawn due to the fan-like action of the brush 2. During rotation of the brush 2, air circulates continually over a path from the gap 6*a*, under the casing 7 to the gap 6*b*, and from the gap 6*b* through the chamber C, back to the gap 6*a*. Toner particles expelled through the gap 6*b* fall directly into the bin 9, if comparatively heavy, or, if lighter and finer, are carried upwards through the chamber C by the circulating air. While thus carried through the chamber C, the toner particles are attracted to the outer side of casing 7 charged with opposite polarity due to the frictional contact of the brush hairs 3. Toner or other admixed particles may also adhere to the housing 8 depending on the polarity of the particles relative to the housing 8. Thus, air coming to and drawn through the gap 6*a* is clean. At suitable intervals the knob 15 is rotated to bring the scraper 12 from the front end of the chamber C to the position indicated by the dotted line portion of FIG. 1, that is, to the rear end of the chamber C, above the open portion 10 and bin 9. As the scraper 12 is moved through the chamber C, the scraper boards 13*a* and 13*b* thereof remove any particles adhering to the casing 7 and housing 8 and push the particles towards the open portion 10, the particles gradually piling together on the scraper boards 13*a* and 13*b*, and falling under gravity into the bin 9 when the scraper 12 reaches the rear of the chamber C. Afterwards, the knob 15 is rotated in the reverse direction, to bring the scraper 12 back to the front end of the chamber C. At longer intervals, the bin 9 is removed and emptied.

In the abovedescribed embodiment of the invention, and in other embodiments thereof, the effectiveness of the casing 7 in attracting toner particles may be greatly increased by the provision of an external voltage supply V which is connected to and imposes a charge with opposite polarity to toner particles on the casing 7. Alternatively, the voltage supply V may, of course, be connected to and impose a charge on the housing 8. However, it is generally easier to connect the voltage supply V to the casing 7 and to ground the housing 8.

Figure 3:
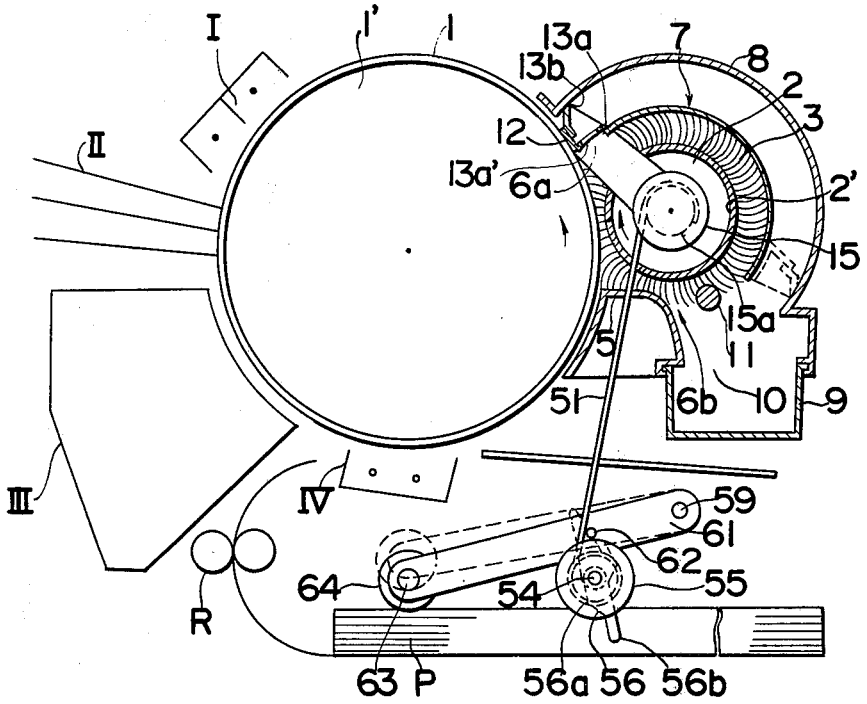
FIG. 3 is a schematic cross-sectional view showing the connection between a scraper actuation means and a copy-paper feed means according to a second embodiment of the present invention.
Figure 4:
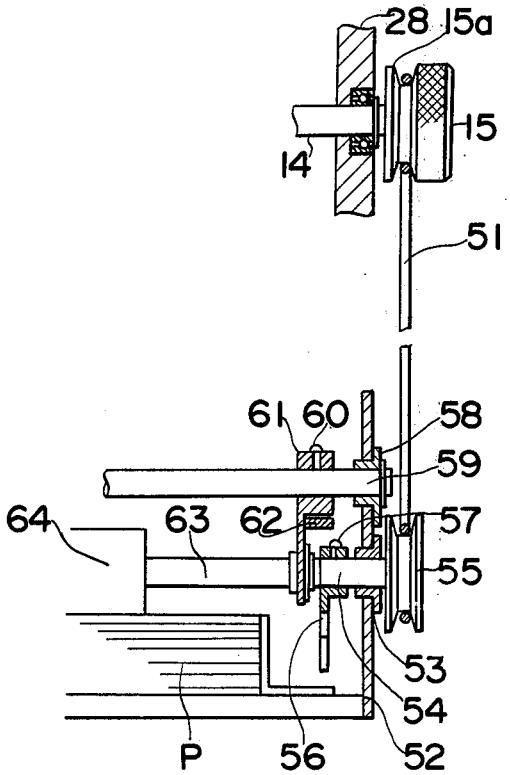
FIG. 4 is a schematic view showing construction details of the means of FIG. 3.

Reference is now made to FIGS. 3 and 4, which show a second embodiment of the invention, wherein the knob 15 for actuation of the scraper 12 is associated with a copy paper press roll.

In FIG. 4, a pulley 15*a* is fixedly and coaxially mounted on the outer end of the shaft 14, between the knob 15 and the outer side of the cover 28. A belt 51 is passed around the pulley 15*a*, leads downwards therefrom, and, in a lower portion of the equipment, is passed around a pulley 55. The pulley 55 is fixedly mounted on the end of a shaft 54, which is rotatably mounted and supported in a bearing 53 provided in a wall of a frame 52. Inside of the wall of the frame 52, a lever 56, which comprises a generally semi-circular cam base portion 56*a* and a rod-like extension portion 56*b*, is fixedly mounted on the shaft 54 by means of a screw 57. Rotation of the knob 15 therefore causes simultaneous rotation of the pulley 55, shaft 54 and lever 56. When the lever 56 is thus rotated (clockwise in FIG. 3), the cam portion 56*a* and then the rod extension 56*b* thereof are brought into contact with and push upwards a pin 62 fixedly attached to an arm 61. In FIGS. 3 and 4, one end of the arm 61 is fixedly attached by a screw 60 to a shaft 59, which is rotatably mounted and supported in a bearing 58 in the wall of the frame 52. The pin 62 is provided at a generally central portion of the arm 61. At the other end of the arm 61 there is mounted a shaft 63, which extends at right-angles to the arm 61, and which is connected to a paper press roll 64. The press roll 64 presses down on a reserve supply of copy paper P, which may be supplied, for example, to the transfer section IV by rollers R. An identical arm 61 and lever 56 are similarly provided on the other side of the frame 52 whereby the press roll 64 is supported at both ends by arms 61, which may be moved by the levers 56, as described below. Also, in the second embodiment, the spring 21 (FIG. 2) mounted in attachment to the shaft 14 of the knob 15 exerts a constant force tending to keep the shaft 14 in the above position in which the cam portion 56*a* and the rod extension 56*b* of the lever 56 engage the pin 62, consequently holding the paper press roll 64 in a raised position through the arm 61.

In reference mainly to FIG. 3, operation of the abovedescribed means is as follows. When the knob 15 is rotated manually clockwise, to bring the scraper 12 from the front to the rear end of the chamber C, the belt 51 simultaneously drives the pulley 55 clockwise, whereby the lever shaft 54 and levers 56 also are rotated clockwise. As the levers 56 are rotated the cam portions 56*a* thereof are brought into contact with the pins 62 on the respective arms 61, whereby the arms 61 are pivoted about the shaft 59, the opposite ends thereof are raised, and the press roll 64 is moved upwards out of contact with the reserve of copy paper P, in which state fresh copy paper sheets may easily be replenished. When the knob 15 has been rotated about 180°, the rod-like extensions 56*b* of the levers 56 are brought to the respective pins 62. If now the knob 15 is released, the spring 21 urges the knob 15 to stay in its position with the lever extensions 56*b* engaging the pins 62, whereby the scraper 12 remains held at the rear of the chamber C, indicated by the dotted line portion of FIG. 3, and the press roll 64 remains out of contact with the reserve of copy paper P for easy replenishment at fresh copy paper sheets. When the replenishment of copy paper P has been completed, the knob 15 is turned manually counterclockwise to bring the scraper 12 back to the front end of the chamber C, consequently turning the levers 56 back to the position in which neither the rod extensions 56*b* nor the cam portions 56*a* thereof contact the respective pins 62, whereby the arms 61 pivot downwards and the press roll 64 is again brought into contact with the reserve of copy paper P. Supply of the copy paper P by the rollers R therefore starts and continues until the next time the knob 15 is rotated clockwise.

Figure 5:
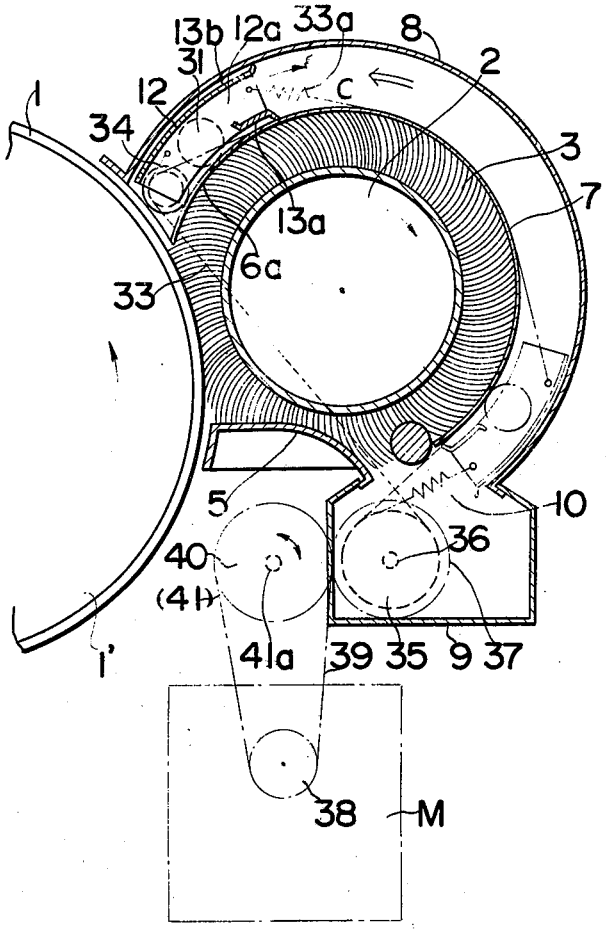
FIG. 5 is a schematic cross-sectional view of a third embodiment of the invention employing a motor-driven scraper actuation means.
Figure 6:
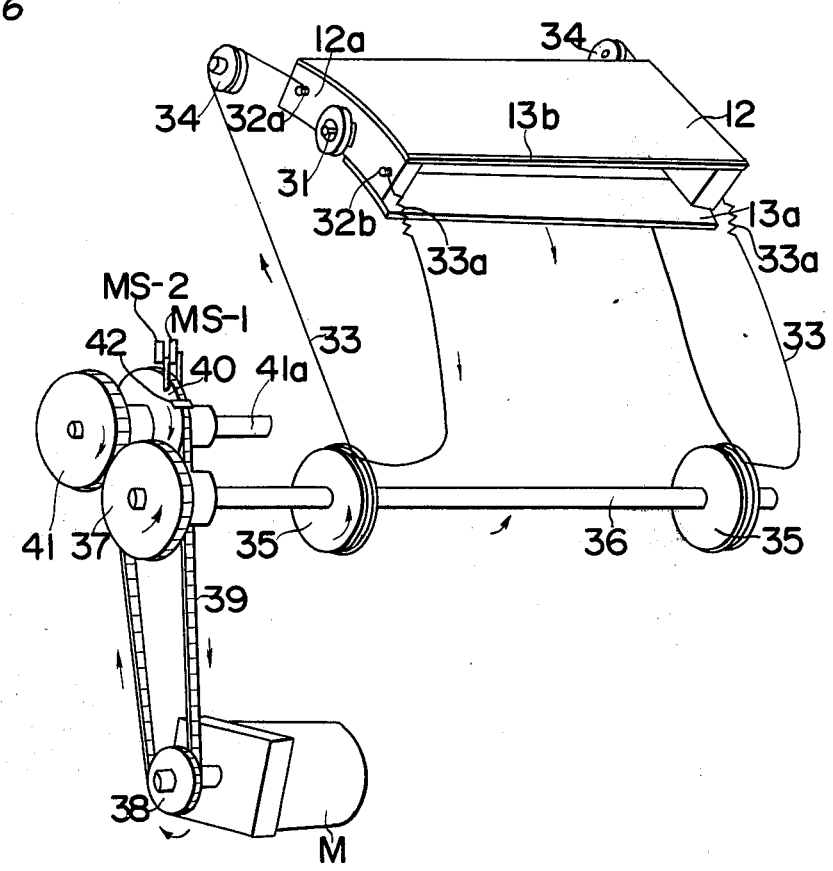
FIG. 6 is a perspective view showing main parts of the means of FIG. 5.

FIGS. 5 and 6 show a third embodiment of the invention, wherein the scraper actuation knob 15 is omitted and the scraper 12 is motor-driven. A roller 31, made of rubber or other insulating material, is mounted on the outer side of each side wall 12*a* of the scraper 12, to permit the scraper 12 to be driven smoothly along the chamber C. Near the front and rear ends of each side wall 12*a* there are affixed attachment pins 32*a* and 32*b*, respectively, the pins 32*a* and 32*b* being made of electrically non-conductive material. To each front pin 32*a* there is fixedly attached one end of a cable 33 made of a non-conductive material. Each cable 33 is led forwards from its respective pin 32*a*, passed around a rotatable pulley 34 mounted in a forward end portion of the chamber C, led downwards and rearwards in a generally straight line to a pulley 35, provided in the vicinity of the bin 9, wound two or three times around the pulley 35 and led upwards therefrom, around the outside of the casing 7, back to the scraper 12. The other end of each cable 33 is in fixed or integral attachment to one end of a spring 33*a*, the other end of which is fixedly attached to the rear pin 32*b* on the respective side wall 12*a*. The springs 33*a* serve to maintain suitable tension in the cables 33. The pulleys 35 are both fixedly mounted on a shaft 36, which is rotatably mounted in a frame F, not shown, below the toner removing apparatus.

In more particular reference to FIG. 6, a gear wheel 37 is fixedly mounted on the shaft 36, near one end thereof. The gear wheel 37 is engaged and driven by a gear wheel 41. The gear wheel 41 is fixedly mounted on a shaft 41*a*, which is rotatably mounted in the frame F, and on which there is fixedly mounted another gear wheel 40. Affixed to, and projecting from the side of the gear wheel 40 there is a pin 42, and near the outer periphery of the gear wheel 40 there are provided microswitches MS-1 and MS-2, one or the other of which is actuated by the pin 42, each time the gear wheel 40 rotates once completely through 360° in the forward or reverse direction (clockwise or counterclockwise in the drawing). The micro-switches MS-1 and MS-2 constitute switching elements in the control circuit of a motor M. The gear wheel 40, and hence the gear wheels 41, 37 and pulleys 35, are driven, upon actuation of the motor M, by a drive chain 39 which passes around the gear wheel 40 and also around a gear wheel 38 which is fixedly mounted on the drive shaft of the motor M. The dimensions of the gear wheels 41, 37 and pulleys 35 are such that when the gear wheel 41 is rotated completely through 360°, the scraper 12 is drawn, by the cables 33, over the complete length of the chamber C.

Supposing the scraper 12 to be at the normal position at the front end of the chamber C, as indicated by the solid line portion of FIG. 5, the pin 42 on the gear wheel 40 contacts the micro-switch MS-1. When the motor M is started, by actuation of a push-button or other suitable means not shown, the motor M supplies forward drive to the gear wheel 38, whereupon the gear wheels 40, 41, 37 and pulleys 35 are rotated in the directions indicated by the arrows in FIG. 6, and the scraper 12 is drawn from the front end of the chamber C towards the rear end thereof, at the same time cleaning the casing 7 and housing 8 of adhering toner particles, as described earlier. As noted, the scraper 12 is drawn over the complete length of the chamber C when the gear wheel 41, and hence gear wheel 40, completes one turn, and so at the same time as the scraper 12 reaches the rear end of the chamber C, the pin 42 on the gear wheel 40 contacts and actuates the micro-switch MS-2, which stops the motor M. Thereafter, when another push-button, or other suitable means, not shown, is actuated the motor M supplies reverse drive to rotate the gear wheel 38, chain 39, gear wheels 40, 41, 37 and pulleys 35 in directions which are the reverse of those indicated by the arrows in FIG. 6, whereupon the scraper 12 is drawn forwards to the front end of the chamber C. When the scraper 12 reaches the front end of the chamber C, the pin 42 on the gear wheel 40 is brought into contact with, and actuates the micro-switch MS-1, which stops the motor M, thus completing one cleaning action. Alternatively, it is, of course, possible to provide only one push-button for actuation of the motor M, and for actuation of the micro-switches MS-1 and MS-2 to effect stopping and reverse drive, respectively, of the motor M.

Figure 7:
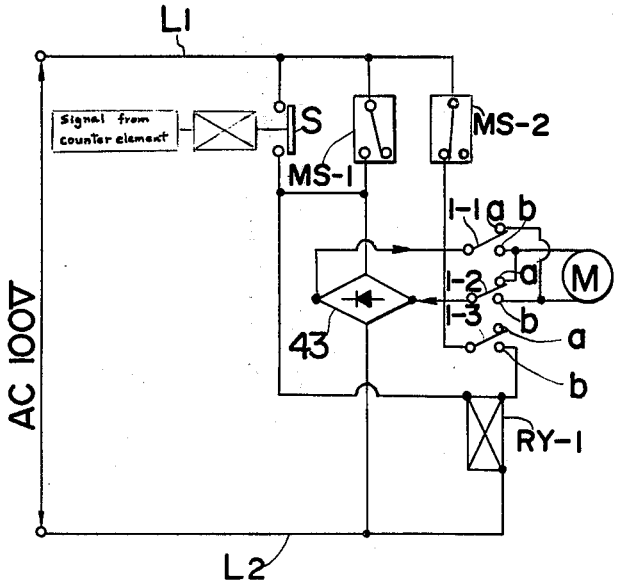
FIG. 7 is a diagrammatic representation of a control circuit for the means of FIG. 5.
Figure 8:
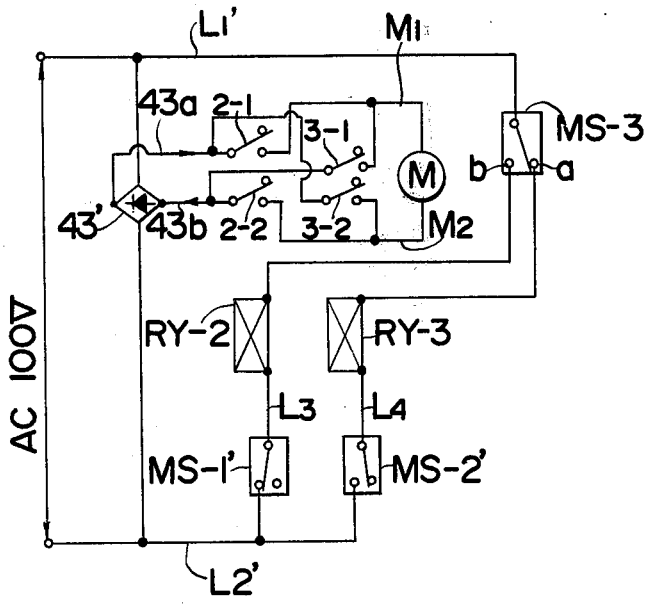
FIG. 8 is a diagrammatic representation of another control circuit for the means of FIG. 5.

FIGS. 7 and 8 show control circuits which may be employed in association with the second embodiment of the invention to effect automatic actuation of the motor-drive means shown in FIGS. 5 and 6.

FIG. 7 shows a circuit to which power, for example AC 100V, is supplied across two lines L1 and L2. On the line L2 there is a self-maintaining relay RY-1 which may be connected to the line L1 through a normally open switch S. The switch S is actuated and closed momentarily upon receipt of a signal from a counter element (not indicated) which counts the number of revolutions of the photoreceptor drum 1', and supplies a signal to close the switch S every time the photoreceptor drum 1' completes 1,000 revolutions, for example. The relay RY-1 controls a normally open switch 1-3, and two switches 1-1 and 1-2, each of which has two making contacts *a* and *b* and normally connected to contact *a*. When the relay RY-1 is energized, the switches 1-1 and 1-2 move from their *a* contacts connected to their respective *b* contacts, and the switch 1-3 closes. The relay RY-1 may also be connected to the line L1 through the switch 1-3, and through the micro-switch MS-2, which is normally closed and is actuable by the pin 42 on the gear wheel 40. The micro-switch MS-1 is normally open, provided in parallel with the micro-switch MS-2, and, when closed, connects the line L1 to a rectifier circuit element 43, which is connected to the line L2. The line between the micro-switch MS-1 and the rectifier element 43 is connected to the relay RY-1 side of the switch S. The micro-switch MS-1 is automatically opened when the micro-switch MS-2 is closed, and vice-versa. The micro-switches MS-1 and MS-2 need not, of course, be separate, but may be constituted by a simple continuity-transfer contact. The rectifier element 43 is further connected to the switches 1-1 and 1-2, and is so disposed that current always flows from swtich 1-2 to switch 1-1. The switch 1-1 *a* contact and the switch 1-2 *b* contact both are connected to one power supply line to the motor M. The switch 1-1 *b* contact and the switch 1-2 *a* contact both are connected to another supply line to the motor M.

The action of the circuit of FIG. 7 is as follows. Each time the brush 2 completes 1,000 revolutions, the abovementioned counter supplies a signal to close the switch S, thus connecting the relay RY-1 to both power lines L1 and L2. The relay RY-1 is therefore energized, the switches 1-1 and 1-2 move to their respective *b* contacts, and the switch 1-3 closes. The switch 1-3 and micro-switch MS-2 now close the circuit between the lines L1 and L2, and also connect the relay RY-1 to the line L1, relay RY-1 therefore remaining energized. Current flows in the motor M, and is directed by the rectifier element 43 to flow from the switch 1-1 *b* contact to the motor M, and from the motor M to the switch 1-2 *b* contact, whereby the motor M is driven forwards, and the pulleys 35 (FIGS. 5 and 6) are rotated to draw the scraper 12 from the front to the rear end of the chamber C, as described earlier. When the scraper 12 reaches the rear end of the chamber C, the pin 42 on the gear wheel 40 (FIG. 6) contacts and closes the micro-switch MS-1, whereupon the micro-switch MS-2 simultaneously opens. The line L1 to line L2 circuit is now closed by the micro-switch MS-1, but the circuit between the line L1 and relay RY-1 is opened. The relay RY-1 is therefore de-energized, the switches 1-1 and 1-2 move to their respective *a* contacts and the switch 1-3 opens. Current continues to flow in the motor M, but from the switch 1-1 *a* contact to the motor M, and from the motor M to the switch 1-2 *a* contact, that is, opposite to the previous direction, whereby the motor M is driven in reverse, and the pulleys 35 are rotated to draw the scraper 12 from the rear to the front end of the chamber C. At the same time as the scraper 12 reaches the front end of the chamber C, the pin 42 on the gear wheel 40 contacts and closes the micro-switch MS-2, whereupon the mocro-switch MS-1 simultaneously opens. This brings the circuit to the original configuration, that is, the power supply circuit between the lines L1 and L2 is open both for the rectifier circuit element 43 and for the relay RY-1. The motor M therefore stops, and remains unactuated until the next time the brush 2 has completed 1,000 revolutions.

Referring now to FIG. 8, there is shown a circuit for actuation of the motor M when the supply of immediately available copy paper for use in the transfer section IV falls below a certain level. In the circuit, a rectifier element 43' is connected to two lines L1' and L2', across which a power supply of, for example, AC 100V is applied. The rectifier element 43' is also connected to two lines 43*a* and 43*b*, the rectifier element 43' being so disposed that current may only flow from line 43*b*, through the rectifier element 43', to line 43*a*. The line 43*a* may be connected through a normally open switch 2-1 to one power line M1 of the motor M, and through a normally open switch 3-2 to the other power line M2 of the motor M. The line 43*b* may be connected to the line M1 through a normally open switch 3-1, and to the line M2 through a normally open switch 2-2. The switches 2-1 and 2-2 are closed upon energization of a relay RY-2 in series with a normally closed micro-switch MS-1' on a line L3, which is connected to the line L2'. The switches 3-1 and 3-2 are closed upon energization of a relay RY-3 in series with a normally open micro-switch MS-2' on a line L4, which also is connected to the line L2', and is parallel to the line L3. The micro-switches MS-1' and MS-2' are located in a position to be actuable by the pin 42 on the gear wheel 40 (FIG. 6), and when one is closed the other is automatically opened. The lines L3 and L4 may be connected to the line L1' by a micro-switch MS-3 having two contacts *a* and *b*. The micro-switch MS-3 is provided, for example, at the lower portion of a container holding copy paper immediately ready for use in the transfer section IV. When there is sufficient paper in the container, the micro-switch MS-3 is at the *a* contact, and connects line L4 and relay RY-3 to line L1′. When the level of paper in the container falls below a certain set level, the micro-switch MS-3 is moved from the *a* contact to the *b* contact, in which position it connects line L3 and relay RY-2 to line L1′.

Operation of this circuit is as follows. In the original configuration, all switches 2-1, 2-2, 3-1 and 3-2 are open, micro-switch MS-1′ is closed, micro-switch MS-2′ is open, and micro-switch MS-3 is at its *a* contact. As copying proceeds and the amount of immediately available copy paper in the transfer section IV falls below a certain level, micro-switch MS-3 closes its *b* contact, thus energizing relay RY-2, which thereupon closes switches 2-1 and 2-2. The AC 100V may now be supplied to the motor M, and is directed by the rectifier element 43′ along line 43*a*, through switch 2-1, to line M1, to the motor M, to line M2, through switch 2-2, to line 43*b*. The motor M is driven forwards and the pulleys 35 draw the scraper 12 to the rear end of the chamber C. When the scraper 12 reaches the rear end of the chamber C, the pin 42 on the gear wheel 40 closes the micro-switch MS-2′, whereupon the micro-switch MS-1′ simultaneously opens. The relay RY-2 is now de-energized, the switches 2-1 and 2-2 therefore open, power to the motor M is cut, and the motor M stops. Copy paper is supplied, by a suitable means, from a reserve to the transfer section IV, and when a certain amount of copy paper has been supplied, the micro-switch MS-3 is again moved back to its *a* contact, whereupon relay RY-3 is energized, and switches 3-1 and 3-2 are closed. Power is now supplied to the motor M, and current is directed by the rectifier element 43′ from line 43*a*, through switch 3-2, to line M2, through the motor M to line M1, through the switch 3-1 to line 43*b*, i.e., the motor M is driven in reverse, to move the scraper 12 to the front end of the chamber C. When the scraper 12 reaches the front end of the chamber C, the pin 42 on the gear wheel 40 contacts and closes the micro-switch MS-1′, whereupon the micro-switch MS-2′ is simultaneously opened. The relay RY-3 is therefore de-energized, the switches 3-1 and 3-2 open, and the circuit is in the original configuration.

From the foregoing description, it has now become clear that, according to the first embodiment of the present invention, the rotating cleaning brush 2 acts as a kind of fan causing an air flow which removes toner particles adhering to the brush hairs 3 and the removed toner particles are adapted to be attracted by the casing plate 7 charged with opposite polarity to the toner particles by friction between the brush hairs 2 and the casing 7 for efficient collection of removed toner particles, thus requiring no separate filter bag for dust collection or vacuum device. The provisions of the external voltage supply V and the bar 11 are effective for better collection of the removed toner particles. The scraper 12 which is advantageously provided in the chamber C scrapes the adhering toner particles off the casing 7 and the housing 8 into the bin 9 as the scraper 12 is moved through chamber C by a simple manual operation.

In the second embodiment of the present invention, as the above manual operation of the scraper 12 is associated with an upward movement of the press roll 64, replenishment of fresh copy paper sheets is efficiently made at the same time as the cleaning operation by the scraper 12.

In the third embodiment of the present invention, the motor-driven scraper 12 is adapted to automatically function when the rotatary cleaning brush 2 completes preset revolutions or when the supply of copy paper in a paper feeding device falls below a preset level, which is very effective in continuous copying of many copy paper sheets at high speed.

As is clear from the above description, the present invention provides a residual toner removing apparatus, which is compact, is easy to construct and to maintain, has low power requirements, and may easily be associated with automatic control means. The invention thus offers the advantages that a copying apparatus may be smaller, and that cost per copy be reduced.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A residual toner removing apparatus for use in an electrostatic copying machine, comprising:

a housing mounted adjacent a photoreceptor surface and having an opening adjacent thereto;

a rotatable cleaning brush having brush hairs;

a casing plate;

a restriction board, said casing plate and said restriction board enclosing said rotatable cleaning brush and being enclosed by said housing, said casing plate and said photoreceptor surface forming an inlet gap, said casing plate contacting said brush hairs, said restriction board and said casing plate forming an outlet gap and compressing said brush hairs, said housing and said casing plate forming a chamber communicating with said inlet and outlet gaps;

charging means coupled to said casing plate for charging said casing plate with a polarity opposite to that of toner particles; and scraper means slidably interposed between and contacting said housing and said casing plate for scraping off toner particles adhering to said casing, whereby said cleaning brush, during rotation, causes an air flow through said inlet and outlet gaps and said chamber, said casing plate electrostatically collects toner particles, and said scraper means scrapes off toner particles adhering to said casing plate.

2. A residual toner removing apparatus as claimed in claim 1 wherein said charging means comprises an external voltage supply.

3. A residual toner removing apparatus as claimed in claim 1, wherein said charging means comprises friction between said casing plate and said brush hairs during rotation of said cleaning brush.

4. A residual toner removing apparatus as claimed in claim 1 further comprising a bar mounted across said outlet gap, said brush hairs colliding with said bar for shaking loose toner particles during rotation of said rotatable cleaning brush.

5. A residual toner removing apparatus as claimed in claim 1 wherein said housing is electrically grounded.

6. A residual toner removing apparatus as claimed in claim 1, further comprising a removable reception bin provided below an opening between a rear end of said restriction board and lower rear portion of said housing, toner particles scraped off by said scraper means being received by said bin.

7. A residual toner removing apparatus for use in an electrostatic copying machine, comprising:

a housing mounted adjacent a photoreceptor surface and having an opening adjacent thereto;

a rotatable cleaning brush having brush hairs;

a casing plate;

a restriction board, said casing plate and said restriction board enclosing said rotatable cleaning brush and being enclosed by said housing, said casing plate and said photoreceptor surface forming an inlet gap, said casing plate contacting said brush hairs, said restriction board and said casing plate forming an outlet gap and compressing said brush hairs, said housing and said casing plate forming a chamber communicating with said inlet and outlet gaps;

charging means coupled to said casing plate for charging said casing plate with a polarity opposite to that of toner particles; and scraper means slidably interposed between and contacting said housing and said casing plate for scraping off toner particles adhering to said casing by sliding between a front end and a rear end of said chamber, said scraper means being comprised of scraper boards operatively associated with a knob means provided externally of said housing so that when said knob means is rotated, said scraper means slides through said chamber between said front and rear ends of said chamber, whereby said cleaning brush, during rotation, causes an air flow through said inlet and outlet gaps and said chamber, said casing plate electrostatically collects toner particles, and said scraper means scrapes off toner particles adhering to said casing plate.

8. A residual toner removing apparatus as recited in claim 7 wherein said scraper board has the same axis of rotation as said brush, said casing plate and said housing forming arcs concentric with said rotatable cleaning brush.

9. A residual toner removing apparatus as claimed in claim 7, wherein said scraper means is provided with a hole said scraper board at a position corresponding to said inlet gap for circulating said air flow.

10. A residual toner removing apparatus for use in an electrostatic copying machine, comprising:

a housing mounted adjacent a photoreceptor surface and having an opening adjacent thereto;

a rotatable cleaning brush having brush hairs;

a casing plate;

a restriction board, said casing plate and said restriction board enclosing said rotatable cleaning brush and being enclosed by said housing, said casing plate and said photoreceptor surface forming an inlet gap, said casing plate contacting said brush hairs, said restriction board and said casing plate forming an outlet gap and compressing said brush hairs, said housing and said casing plate forming a chamber communicating with said inlet and outlet gaps;

charging means coupled to said casing plate for charging said casing plate with a polarity opposite to that of toner particles;

scraper means slidably interposed between and contacting said housing and said casing plate for scraping off toner particles adhering to said casing by sliding between a front end and a rear end of said chamber; and paper roll press means operatively coupled to said scraper means for contacting a paper supply and supplying paper when said scraper means is at the front end of the chamber and being separated from the paper supply when said scraper means slides to the rear end of the chamber, replenishment of paper being performed when said paper roll press means assumes the latter position, whereby said cleaning brush, during rotation, causes an air flow through said inlet and outlet gaps and said chamber, said casing plate electrostatically collects toner particles, and said scraper means scrapes off toner particles adhering to said casing plate.

11. The residual toner removing apparatus as recited in claim 10, wherein said scraper means is comprised of an actuating knob member for manually moving said scraper means between said front and rear ends, thereby manually adjusting said paper roll press means.

12. A residual toner removing apparatus for use in an electrostatic copying machine, comprising:

a housing mounted adjacent a photoreceptor surface and having an opening adjacent thereto;

a rotatable cleaning brush having brush hairs;

a casing plate;

a restriction board, said casing plate and said restriction board enclosing said rotatable cleaning brush and being enclosed by said housing, said casing plate and said photoreceptor surface forming an inlet gap, said casing plate contacting said brush hairs, said restriction board and said casing plate forming an outlet gap and compressing said brush hairs, said housing and said casing plate forming a chamber communicating with said inlet and outlet gaps;

charging means coupled to said casing plate for charging said casing plate with a polarity opposite to that of toner particles;

scraper means slidably interposed between and contacting said housing and said casing plate for scraping off toner particles adhering to said casing by sliding between a front end and a rear end of said chamber; and motor means operatively coupled to said scraper means for driving said scraper means, whereby said cleaning brush, during rotation, causes an air flow through said inlet and outlet gaps and said chamber, said casing plate electrostatically collects toner particles, and said scraper means scrapes off toner particles adhering to said casing plate.

13. The residual toner removing apparatus of claim 12 further comprising counter means operatively associated with a rotatable photoreceptor drum for counting the number of revolutions of said drum and control means operatively coupled to said photoreceptor drum and said motor means for automatically sliding said scraper means to the rear end of said chamber after said photoreceptor drum has completed a predetermined number of revolutions.

14. The residual toner removing apparatus of claim 12 further comprising paper feeding means operatively coupled for supplying paper from a paper supply for production of a copy thereon, detection means operatively positioned for detecting when said paper supply has been depleted to below a predetermined level, and control means coupled to said detection means and said motor means for automatically sliding said scraper means to the rear end of said chamber when said paper supply falls below said predetermined level.

* * * * *